United States Patent [19]

Yanagihara

[11] Patent Number: 4,658,605

[45] Date of Patent: Apr. 21, 1987

[54] WASHING MACHINE

[75] Inventor: Masanobu Yanagihara, Gifu, Japan

[73] Assignee: Kabushiki Kaisha Toshiba, Kawasaki, Japan

[21] Appl. No.: 709,374

[22] Filed: Mar. 7, 1985

[30] Foreign Application Priority Data

| | | | |
|---|---|---|---|
| Mar. 16, 1984 | [JP] | Japan | 59-51973 |
| Mar. 16, 1984 | [JP] | Japan | 59-51974 |
| Mar. 16, 1984 | [JP] | Japan | 59-51975 |

[51] Int. Cl.[4] ..... D06F 39/08; D06F 39/10

[52] U.S. Cl. ..... 68/23.5; 68/18 F; 68/26; 68/207; 210/95; 210/437

[58] Field of Search ..... 68/18 F, 23.5, 26, 148, 68/207; 210/95, 437; 137/533.19

[56] References Cited

U.S. PATENT DOCUMENTS

| | | | |
|---|---|---|---|
| 2,230,771 | 2/1941 | Wiltshire | 68/26 X |
| 2,287,670 | 6/1942 | Dever | 210/95 |
| 2,639,783 | 5/1953 | Kovacs | 210/437 X |
| 2,691,883 | 10/1954 | Abrams | 68/26 |

FOREIGN PATENT DOCUMENTS

| | | | |
|---|---|---|---|
| 474588 | 6/1951 | Canada | 137/533.19 |
| 58-3912 | 6/1981 | Japan . | |
| 896683 | 5/1962 | United Kingdom . | |
| 2055902 | 3/1981 | United Kingdom | 68/26 |

*Primary Examiner*—Philip R. Coe

*Attorney, Agent, or Firm*—Cushman, Darby & Cushman

[57] ABSTRACT

A washing machine has an outer casing in which a washing tub and a dryer tub are arranged. A control box with a holding recess is mounted on the outer casing. A filter is removably set in the holding recess. The filter filtrates water supplied from a tap and feeds the filtrated water into the dryer tub.

16 Claims, 9 Drawing Figures

WASHING MACHINE

BACKGROUND OF THE INVENTION

The present invention relates to a washing machine, and more specifically to a washing machine in which water is poured on laundry in a dryer tub, and the dryer tub is rotated for rinsing.

When using washing machines of this type in districts where water supply is not clear, laundry will be discolored by iron oxide powder or other impurities contained in the water, if the water is poured on the laundry in a dryer tub for rinsing. Therefore, washing machines intended for use in impure water districts need to be provided with a filter for filtrating the water fed from the water supply to the dryer tub. Normally, the filter is provided independently of the washing machines.

In this case, the filter should be manufactured independently of the washing machine, and the washing machine may be of exactly the same construction as the washing machines which are intended for use in clear water districts. Thus, there are no problems on the manufacture of the washing machines. In use, however, the filter requires a setting space separate from that for the washing machine, resulting in an increase of the overall setting space and a decrease in the handling efficiency.

SUMMARY OF THE INVENTION

The present invention is contrived in consideration of these circumstances, and is intended to provide a washing machine capable of filtering water from water supply and reducing the setting space.

In order to achieve the above object, a washing machine according to the present invention is so constructed that a filter manufactured independently of the main body of the washing machine is detachably attached to the main body.

According to the washing machine of the invention, therefore, the filter does not require any exclusive setting space, thereby reducing the overall setting space required. Moreover, the main body of the washing machine intended for use with the filter may be used directly as a filterless washing machine, leading to an improvement in productivity of the washing machine.

BRIEF DESCRIPTION OF THE DRAWINGS

FIGS. 1 to 7 show a washing machine according to a first embodiment of the present invention, in which FIG. 1 is a perspective view showing the principal part of the washing machine, FIG. 2 is a sectional view of the upper portion of a dryer tub, FIG. 3 is a sectional view taken along line III—III of FIG. 1, FIG. 4 is a sectional view taken along line IV—IV of FIG. 1, FIG. 5 is a longitudinal sectional view of a flow regulator, FIG. 6 is an exploded perspective view showing the principal part of the flow regulator, and FIG. 7 is a sectional view showing the principal part of the washing machine with its filter removed therefrom; and FIGS. 8 and 9 show a washing machine according to a second embodiment of the invention, in which FIG. 8 is a perspective view showing the principal part of the washing machine, and FIG. 9 is an enlarged sectional view of a flow indicator.

DETAILED DESCRIPTION OF THE PREFERRED EMBODIMENTS

Preferred embodiments of the present invention applied to a double-tub washing machine will now be described in detail with reference to the accompanying drawings.

Figure 1:
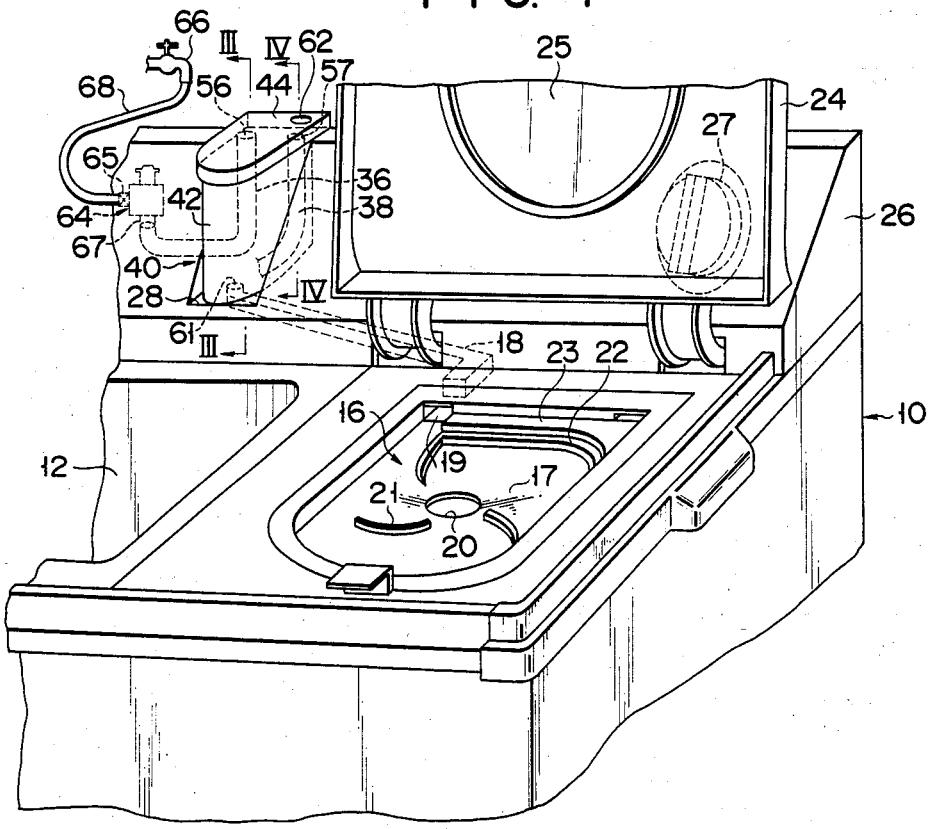
Figure 2:
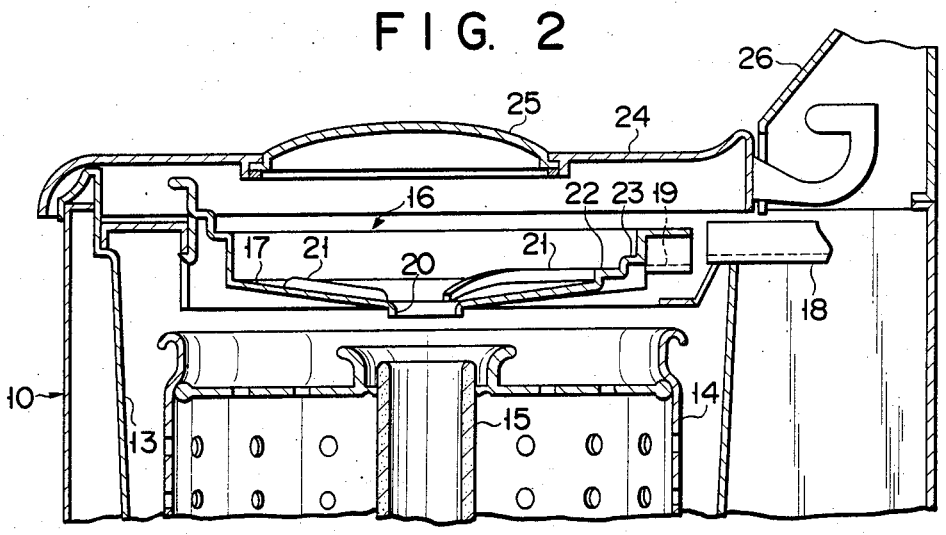

As shown in FIGS. 1 and 2, the main body of the washing machine includes an outer casing 10 in which are arranged a washing tub 12 and a dryer tub 13. Disposed in the dryer tub 13 is a rotatable dryer vessel 14 which is driven by a motor (not shown). A water sprinkling cylinder 15 formed of a water-permeable porous material is set up in the central portion of the dryer vessel 14. An inner lid 16 is attached to the top portion of the dryer tub 13, whereby the top opening of the dryer tub 13 is opened and closed. The whole body of the inner lid 16 except its peripheral edge portion is depressed downward, forming a flooder 17. An entrance opening 19 is formed at the left-hand rear portion of the inner lid 16. The entrance opening 19 serves to lead water, which is fed through a water supply pipe 18 in the casing 10 in the manner mentioned later, into the flooder 17.

A pouring aperture 20 is formed in the center of the bottom portion of the flooder 17, facing the top opening of the sprinkling cylinder 15. Guide ribs 21, e.g., three in number, protrude from the upper surface of the bottom portion of the flooder 17, whereby the water introduced into the flooder 17 through the entrance opening 19 is led into the pouring aperture 20. Stepped portions 22 and 23 for indicating flow quantity are formed at the rear end portion of the flooder 17. An outer lid 24 is provided over the inner lid 16. A see-through window 25 formed of a transparent plate lid 24 so as to face the flooder 17. The washing machine also includes a control box 26 mounted on the rear portion of the top end face of the casing 10. Knobs for operating a washer timer (not shown), a dryer timer 27, etc., are provided on the front portion of the control box 26. Further, a holding recess 28 is formed in the control box 26, corresponding in position to the washing tub 12.

Figure 4:
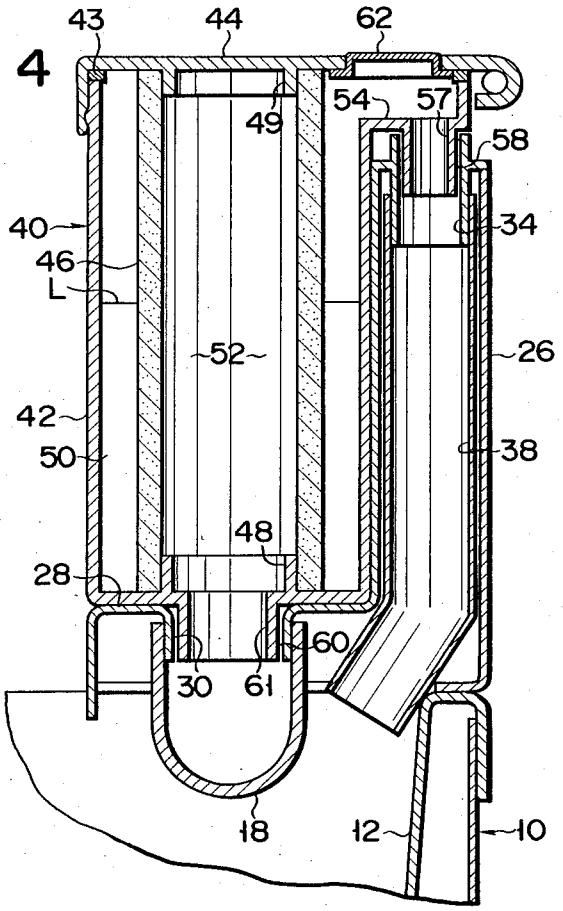
Figure 3:
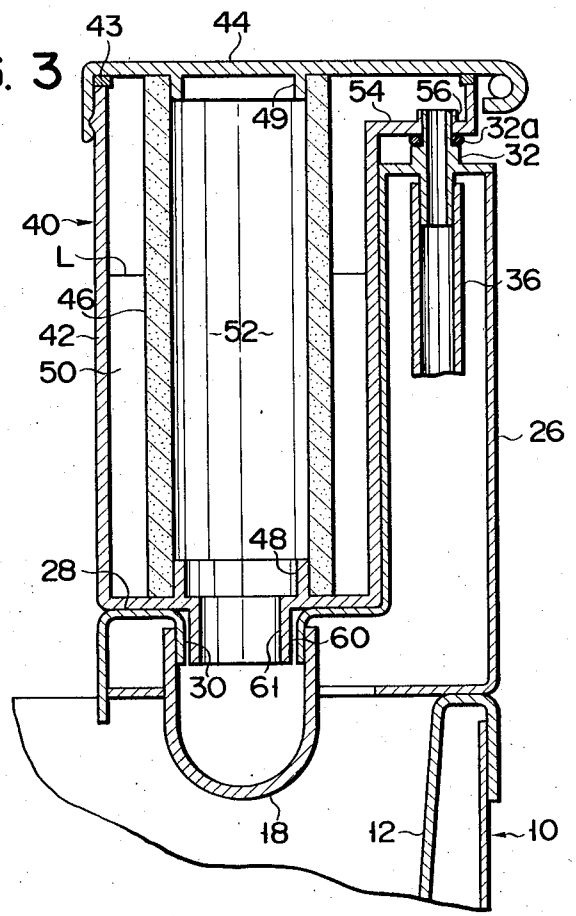

As shown in FIGS. 1, 3 and 4, the holding recess 28 opens both forward and upward. The holding recess 28 is formed at its bottom portion with a socket 30 which is coupled to the upper end of the water supply pipe 18. A joint pipe portion 32 (FIG. 3) with a sealing member 32*a* and a socket 34 (FIG. 4) are arranged side by side at the top end face portion of the control box 26 which is located behind the holding recess 28. The lower end of the joint pipe portion 32 is connected to a feed water valve 64 (mentioned later in detail) by means of a coupling pipe 36. The lower end of the socket 34 opens into the washing tub 12 through an overflow pipe 38.

A filter 40 is removably set in the holding recess 28. The construction of the filter 40 will now be described in detail. The filter 40 includes a body case 42 in the form of an open top vessel and a cover member 44 detachably attached to the top opening of the body case 42 with a sealing member 43 between them. A cylindrical filtering member 46 is disposed in the body case 42. Both end portions of the filtering member 46 are fitted individually on a fitting boss 48 on the inner bottom portion of the body case 42 and a fitting boss 49 on the lower surface of the cover member 44. The filtering member 46 divides the interior of the body case 42 into an inflow chamber 50 located outside the filtering member and an outflow chamber 52 located inside the filtering member. The body case 42 includes a flat portion 54 which projects rearward (to the right of FIGS. 3 and 4) at the upper portion of the inflow chamber 50. The flat portion 54 is formed with a water inlet port 56 (FIG. 3) and an overflow pipe portion 58 (FIG. 4) extending downward and defining an overflow port 57 therein. The water inlet port 56 and the overflow pipe portion 58 are arranged on the left and right sides (FIG. 1) of a partition wall (not shown) provided on the flat portion 54, respectively. A water outlet pipe portion 60 protrudes downward from the bottom of the body case 42, defining a water outlet port 61 which opens into the outflow chamber 52. When the body case 42 is set in the holding recess 28, the water inlet port 56 is removably coupled to the joint pipe portion 32 from above, while the overflow pipe portion 58 is also removably fitted into the socket 34 from above. As a result, the overflow port 57 of the body case 42 communicates with the outside air through the overflow pipe 38. Also, the water outlet pipe portion 60 is removably fitted into the socket 30 from above, so that the water outlet port 61 communicates with the water supply pipe 18. Thus, the filter 40 is detachably attached to the holding recess 28 of the washing machine. Numeral 62 designates a transparent cap attached to that part of the cover member 44 which is located directly over the overflow port 57. The interior of the inflow chamber 50, including the region around the overflow port 57, can be seen through the transparent cap 62.

Figure 5:
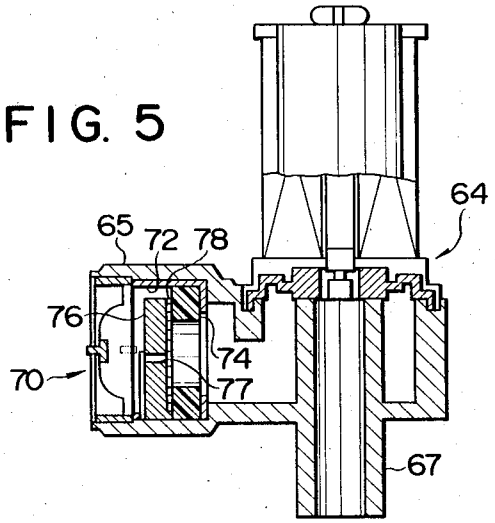
Figure 6:
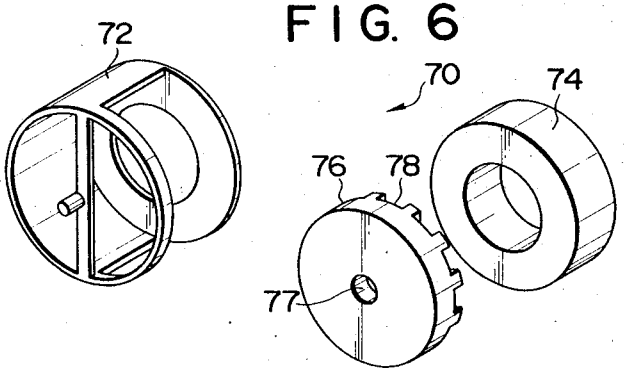

As shown in FIG. 1, the feed water valve 64 is disposed inside the control box 26. A water inlet portion 65 of the feed water valve 64 is coupled to a tap 66 as water supply by means of a hose 68, while a water outlet portion 67 thereof is connected to the joint pipe portion 32 by means of the coupling pipe 36. A flow regulator 70 is provided in the water inlet portion 65 of the feed water valve 64, whereby the flow rate of the water fed into the inflow chamber 50 of the filter 40 is kept constant. A specific construction of the flow regulator 70 is shown in FIGS. 5 and 6. The flow regulator 70 is provided with a passage case 72 housed in the water inlet portion 65 of the feed water valve 64, a ring-shaped seat 74 of soft rubber contained in the passage case 72, and a throttle valve disk 76 joined together with the ring-shaped seat 74. The throttle valve disk 76 is formed with a passage port 77 in substantially its center and a number of water channels 78 in the peripheral edge portion on the side of the ring-shaped seat 74. In this arrangement, when the tap water pressure is increased, the throttle valve disk 76 moves so as to press into the ring-shaped seat 74, so that the cross-sectional passage area of each water channel 78 is decreased. Thus, the rate of water flow is substantially constant without regard to the change of water pressure.

The operation of the washing machine constructed in this manner will now be described. In a drying-rinsing operation after detergent-washing, the tap 66 is turned on in advance. Substantially at the same time, the detergent-washed laundry is put into the inside space of the dryer vessel 14 around the sprinkling cylinder 15, and the inner and outer lids 16 and 24 are closed. In this state, the dryer timer 27 is adjusted so that the dryer vessel 14 is quickly rotated by a dryer motor (not shown), thereby centrifugally separating the detergent solution in the laundry. After a predetermined time of drying, the dryer vessel 14 is driven intermittently, and the feed water valve 64 is energized to be opened. Tap water introduced into the water inlet portion 65 of the feed water valve 64 is adjusted to a constant flow rate by the flow regulator 70, and is fed from the water outlet portion 67 into the inflow chamber 50 through the coupling pipe 36. Thus, the inflow chamber 50 can be supplied with water at a constant flow rate only if the tap 66 is turned on for any opening, so that a user need not adjust the opening of the tap 66. The water fed into the inflow chamber 50 is stored therein and permeates the filtering member 46 by its pressure head. The filtering member 46 collects and removes impurities such as iron oxide powder from the water. The filtrated water enters the outflow chamber 52 and then flows down through the water outlet port 61 into the water supply pipe 18. Immediately after the start of the water feed, the level of water in the inflow chamber 50 is low and the pressure head of the water is small, so that the flow rate of the water passing through the filtering member 46 is lower than that of the water being fed into the inflow chamber 50. Accordingly, the water level of the inflow chamber 50 gradually rises. With the rise of the water level, however, air in the inflow chamber 50 is discharged to the outside of the body case 42 through the overflow port 57 and the overflow pipe 38. Therefore, the internal pressure of the body case 42 will never be increased. After a short time, the flow rate of the water fed into the inflow chamber 50 becomes equal to that of the water passing through the filtering member 46. From that time on, the water level of the inflow chamber 50 is kept at a normal water level as indicated by full line L in FIGS. 3 and 4. As mentioned before, the inflow chamber 50 is supplied with water at a constant flow rate without regard to the opening of the tap 66. Therefore, the water level L is fixed irrespectively of the opening of the tap 66 unless the filtering member 46 is soiled to a critical degree. Thus, as long as the filtering member 46 is clean enough to function, the water level L will never rise, and the water will never overflow through the overflow port 57, even though the tap 66 is turned on at full force. Meanwhile, the water filtrated by the filtering member 46 and introduced through the water outlet port 61 into the water supply pipe 18 flows down through the water supply pipe 18. Reaching the lower end of the water supply pipe 18, the water flows through the entrance opening 19 into the flooder 17, and then flows down through the pouring aperture 20 into the sprinkling cylinder 15. The water thus fed into the sprinkling cylinder 15 is spouted through the peripheral wall of the sprinkling cylinder 15 by centrifugal force to dampen the laundry surrounding the cylinder 15. The water absorbed in the laundry in this manner is separated therefrom by a centrifugal drying effect produced as the dryer vessel 14 rotates. The laundry is rinsed by repeating the alternate dampening and drying cycles. In this case, even if iron oxide powder or other impurities are contained in the tap water discharged from the tap 66, they can be collected and removed by the filtering member 46. Thus, the laundry can be protected against discoloration by the drying-rinsing operation even if the used tap water is of poor quality.

When the filtering member 46 is soiled to a critical degree after prolonged use, the water permeability resistance of the filtering member 46 increases. By the agency of the flow regulator 70, however, the inflow chamber 50 can be supplied with the water at a constant flow rate. Therefore, the water level of the inflow chamber 50 rises beyond the normal water level L. However, if the water level reaches the opening of the overflow port 57 at the predetermined height in the inflow chamber 50, the water overflows through the overflow port 57 and flows through the overflow pipe 38 into the washing tub 12. Thus, the user can realize that the filtering member 46 is used up by visually perceiving the water flowing from the overflow pipe 38 into the washing tub 12. Based on this visual check, the user may replace the filtering member 46 with a new one at the proper time. Even if the filtering member 46 is soiled to such a degree that the water level of the inflow chamber 50 rises extraordinarily, the water level will cease to rise at a level a little higher than the opening of the overflow port 57. Accordingly, the tap water pressure will never be exerted directly on the body case 42. In this embodiment, therefore, the body case 42 can be useful even though it does not have a pressure-resistant structure. The cover member 44 of the body case 42 is provided with the transparent cap 62, so that the user can see, through the transparent port 62, the water level of the inflow chamber 50 and the presence or absence of overflow through the overflow port 57. By doing this, the proper time for the replacement of the filtering member 46 can be chosen. In this embodiment, moreover, the flooder 17 is provided with the stepped portions 22 and 23 for flow rate indication, so that the user can measure the level of water in the flooder 17, using the stepped portions 22 and 23 as base lines. In this manner, the flow rate of the water flowing into the flooder 17 or that of the water flowing out of the outflow chamber 52 can be detected. Thus, the user may check the filtering member 46 for operating conditions also by measuring the water level of the flooder 17.

Figure 7:
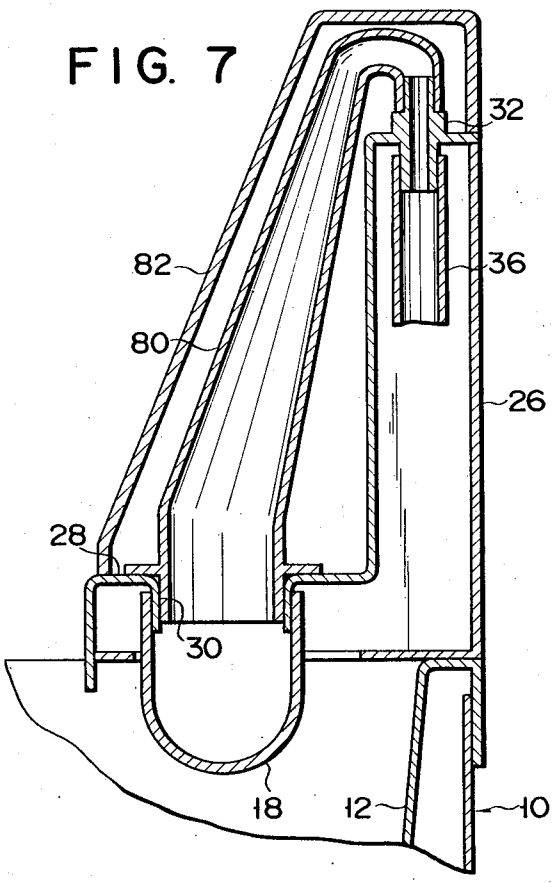

Normally, the filter 40 is removably set in the holding recess 28 of the control box 26. However, if the washing machine is intended for use in districts where tap water is clear, the filter may be omitted. In this case, the joint pipe portion 32 and the socket 30 are connected by means of a connecting pipe 80, and the open face portion of the holding recess 28 is covered with a face panel 82, as shown in FIG. 7.

In the aforementioned case, tap water fed from the feed water valve 64 through the coupling pipe 36 flows into the water supply pipe 18 through the connecting pipe 80. Thereafter, the water is poured into the dryer vessel 14 in the same manner as aforesaid.

The details of the construction and operation of the other members of the washing machine, including the dryer tub 13 and the dryer vessel 15, are disclosed in U.S. Pat. No. 4,356,711.

According to the present embodiment, as described above, the filter 40 is detachably attached to the holding recess 28 which is formed in the control box 26 of the washing machine body. Therefore, the filter 40 may be set in place by putting it into the holding recess 28 from above and coupling the water inlet port 56, the overflow pipe portion 58, and the water outlet pipe portion 60 to the joint pipe portion 32 and the sockets 34 and 30, respectively. Thus, the mounting of the filter 40 is easy. If the filter 40 is unnecessary, it may readily be replaced with the connecting pipe 80 which connects the joint pipe portion 32 and the socket 30 and the face panel 82 which covers the open face portion of the holding recess 28, as shown in FIG. 7. Also, the washing machine body need not be changed in structure without regard to the use of the filter 40, ensuring high productivity. Since the filter 40 is provided in the control box 26 of the washing machine, it requires no exclusive setting space. For the disposal of water discharged from the overflow port 57, if the filter 40 is set in the washing machine body, as in this embodiment, it can easily be connected to a drain pipe for the washing machine. Unlike the prior art filter provided independently of the washing machine, the filter 40 of this embodiment will never render the floor wet. Thus, the washing machine is greatly improved in working efficiency.

In the washing machine according to this embodiment, moreover, the overflow port communicating with the outside air is provided at a predetermined height in the inflow chamber, and the flow regulator is used to adjust the water fed from water supply into the inflow chamber to a constant flow rate. Thus, the inflow chamber is supplied with water at a constant flow rate under the control of the flow regulator. If the filtering member is soiled to a critical degree, therefore, the water level of the inflow chamber rises, and the water overflows through the overflow port. In consequence, the critical condition of the filtering member can be noticed by watching the overflowing water. Based on this visual check, the user can replace the filtering member at the proper time. Further, the overflow port serves to prevent the internal pressure of the inflow chamber from increasing, so that the body case constituting the inflow chamber need not have a pressure-resistant structure, permitting reduction in manufacturing cost. Since the water fed into the inflow chamber can be adjusted to a constant flow rate by the flow regulator, it is unnecessary to adjust the opening of the tap for a proper flow rate for every use. Thus, the washing machine is improved in working efficiency.

Figure 8:
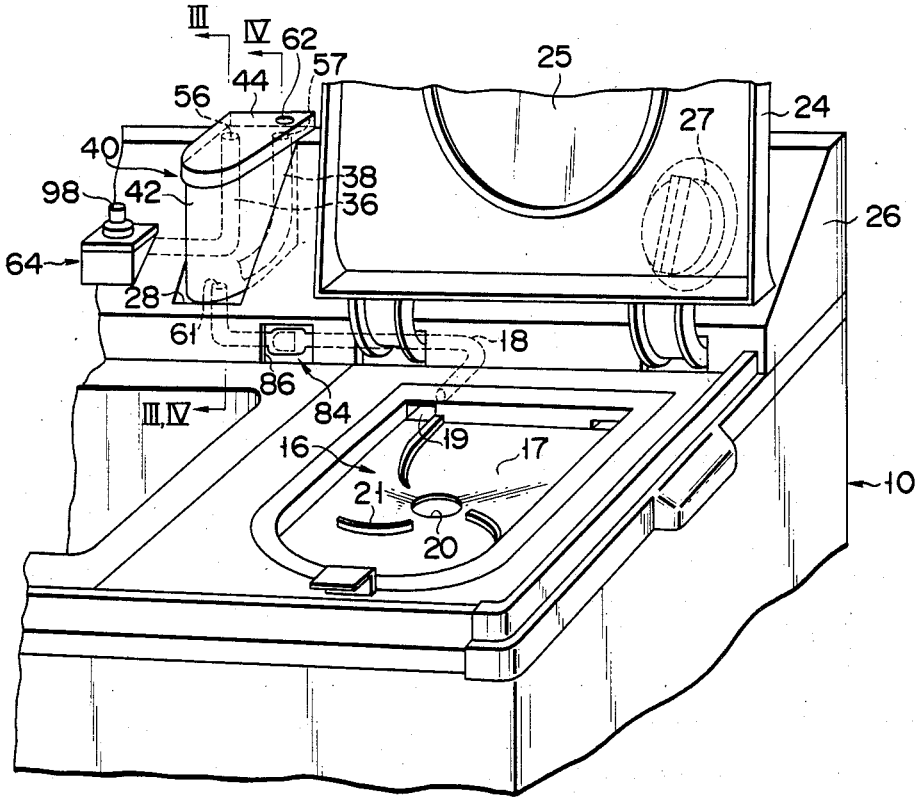
Figure 9:
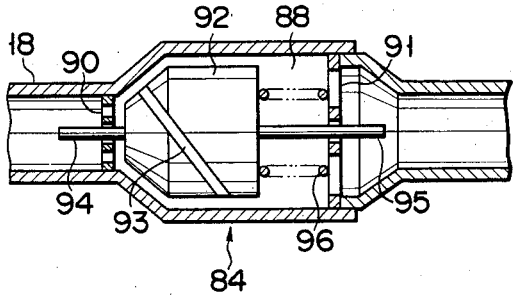

FIGS. 8 and 9 show a washing machine according to a second embodiment of the present invention. In this second embodiment, a flow indicator 84 is used in place of the flow regulator. In other respects, the second embodiment shares the construction with the first embodiment. In FIGS. 8 and 9, therefore, like reference numerals are used to designate like portions as included in the first embodiment, and a description of such portions is omitted herein.

As shown in FIG. 8, the flow indicator 84 is provided at the middle portion of the water supply pipe 18. The indicator 84 can be seen from outside of the control box 26 through an opening 86 which is formed in the front portion of the control box 26. Referring now to FIG. 9, a specific construction of the flow indicator 84 will be described. The flow indicator 84 includes a measuring chamber 88 which is formed by extending the middle portion of the water supply pipe 18 in diameter and then tapering both ends of the extended portion. The peripheral wall portion of the measuring chamber 88 is formed of a transparent material so that the interior of the measuring chamber 88 can be seen from the outside. Support frames 90 and 91 are fixed individually at the two end portions of the measuring chamber 88, and a cylindrical moving body 92 is contained in the measuring chamber 88. Naturally, the diameter of the moving body 92 is smaller than the inside diameter of the measuring chamber 88. The moving body 92 is tapered at the left end portion thereof and has a groove 93 on its outer peripheral surface. The groove 93 is so designed that the moving body 92 is rotated as the water passes through the groove 93, whereby the moving body 92 is stably held in position for indication. Shafts 94 and 95 protrude from the left and right end faces of the moving body 92, respectively, and are passed through their corresponding support frames 90 and 91 for longitudinal movement. A compression coil spring 96 is interposed between the moving body 92 and the support frame 91, whereby the moving body 92 is normally urged to the left. A scale (not shown) for flow rate indication is provided on the outer surface of the flow indicator 84, that is, on the outer surface of the peripheral wall of the measuring chamber 88. The scale represents the longitudinal or axial displacement of the moving body 92 in terms of flow rate, especially a flow rate equivalent to the water permeability of the filtering member 46. In FIG. 8, numeral 98 designates a hose coupling attached to the control box 26. A hose (not shown) leading to water supply is connected to the hose coupling 98.

According to the second embodiment constructed in this manner, the water discharged from the filter 40 into the water supply pipe 18 flows to reach the flow indicator 84. The water flows through the gap between the moving body 92 and the inner surface of the measuring chamber 88 to the right while carrying the moving body 92 to the right against the elastic force of the compression coil spring 96, in accordance with its flow rate. At this time, the moving body 92 is moved to the right in proportion to the flow rate of the water flowing through the water supply pipe 18, that is, the flow rate of the water flowing out of the filter 40. Thus, the position of the moving body 92 indicates the flow rate of the water discharged from the water outlet port 61 of the filter 40. Accordingly, the flow rate of the water flowing out of the filter 40 can be measured by determining the position of the moving body 92, compared with the scale (not shown) for flow rate indication, through the peripheral wall portion of the measuring chamber 88. Thus, if the flow rate measured on the flow indicator 84 is less than a predetermined value, the user should widen the opening of the tap as required, thereby increasing the flow rate of the water to be fed into the filter 40. When the value indicated by the flow indicator 84 reaches the predetermined value, the user releases his or her hold of the tap. When the flow rate of the water discharged from the filter 40 reaches the predetermined value, the level of water in the inflow chamber 50 of the filter 40 is kept at a normal water level indicated by full line L in FIGS. 3 and 4. On the other hand, if the value indicated by the flow indicator 84 is higher than the predetermined value, the tap should be adjusted to a narrower opening. Thus, by adjusting the tap in accordance with the value indicated by the flow indicator 84, the flow rate of the water fed into the inflow chamber 50 of the filter 40 can be regulated corresponding to the water permeability of the filtering member 46. Accordingly, the filter 40 can be securely prevented from being supplied with water beyond its water permeability to cause wasteful discharge of excessive water through the overflow port 57 of the body case 42. Also, the dryer vessel 14 never fails to be supplied with a sufficient quantity of water. The water passed through the flow indicator 84 flows from the lower end of the water supply pipe 18 into the flooder 17 through the entrance opening 19, and flows down from the pouring aperture 20 into the sprinkling cylinder 14.

According to the second embodiment constructed in this manner, the flow rate of the water discharged from the filter can be indicated by the flow indicator, so that the flow rate of the water to be fed into the inflow chamber of the filter can be adjusted to a value corresponding to the water permeability of the filtering member by adjusting the opening of the tap in accordance with the indicated value. As a result, it is possible to prevent excessive water feed to the inflow chamber which will lead to wasteful water discharge through the overflow port, and to avoid short water supply. If the filtering member is soiled to a critical degree, moreover, the value indicated by the flow indicator (i.e., flow rate of water discharged from the water outlet port) will not be able to reach the predetermined value even though the tap is adjusted to a wider opening. Thus, the critical condition of the filtering member can be detected by perceiving such a situation, and the filtering member can be replaced at the proper time, based on the detection.

It is to be understood that the present invention is not limited to the embodiments described above, and that various changes and modifications may be effected therein by one skilled in the art without departing from the scope of the invention.

For example, the filter 40 may be provided at the outer casing of the washing machine instead of being attached to the control box. In the first embodiment, the transparent cap of the cover member and the stepped portions for flow rate indication of the flooder can be omitted. Without the use of these elements, the critical condition of the filtering member can be detected by visually perceiving an overflow into the washing tub through the overflow port. Moreover, in the second embodiment, the stepped portions 22, 23 shown in the first embodiment may be used instead of the flow indicator 84.

What is claimed is:

1. A washing machine comprising:

a main body including a washing tub and a dry tub; and filter means for filtrating water from a water supply and feeding the filtrated water to the main body, said filter means including a body case detachably mounted on the main body, and a filtering member removably set in the body case and dividing the interior of the body case into an inflow chamber supplied with the water from the water supply and communicating with the outside air, and an outflow chamber supplied with the water filtrated by the filtering member and communicating with the interior of the main body.

2. The washing machine according to claim 1, wherein said body case includes a water inlet port opening into the inflow chamber and a water outlet port opening into the outflow chamber, and said main body includes a holding recess for containing the body case therein.

3. The washing machine according to claim 2, wherein said holding recess includes a joint portion, a first socket, and a second socket which are removably connected to the water inlet port, the water outlet port, and the overflow port of the filter, respectively.

4. The washing machine according to claim 3, wherein said main body includes a water supply pipe having one end connected to the first socket and the other end which opens into the dryer tub, an overflow pipe having one end connected to the second socket and the other end which opens into the washing tub, and a coupling pipe having one end connected to the joint portion and the other end connected to the water supply.

5. The washing machine according to claim 3, wherein said main body includes a connecting pipe adapted to connect the first and second sockets and a face panel for covering the holding recess when the filter is removed from the holding recess.

6. The washing machine according to claim 2, wherein said main body includes an outer casing containing the washing tub and the dryer tub, and a control box provided on the outer casing, said holding recess being formed in the control box.

7. The washing machine according to claim 1, wherein said filtering member is in the form of a hollow cylinder, said inflow chamber is defined by the outer peripheral surface of the filtering member and the inner surface of the body case, and said overflow chamber is defined by the inner peripheral surface of the filtering member.

8. The washing machine according to claim 1, wherein said body case includes a transparent portion near the overflow port through which the overflow port and the interior of the inflow chamber are seen from the outside of the body case.

9. The washing machine according to claim 1, further comprising flow control means for adjusting the water fed from the water supply to the filter to a constant flow rate.

10. The washing machine according to claim 9, wherein said main body includes a coupling pipe having one end connected to the water supply and the other end connected to the filter, and said flow control means includes a ring-shaped passage case fixed in the coupling pipe, a ring-shaped seat of an elastic material fixedly fitted in the passage case, and a throttle valve disposed in the passage case to be movable in accordance with the pressure of the water passing through the coupling pipe and adapted to adjust the flow rate in cooperation with the seat.

11. The washing machine according to claim 1, further comprising a flow indicator for indicating the flow rate of the water fed from the filter into the main body.

12. The washing machine according to claim 11, wherein said main body includes a water supply pipe having one end connected to the filter and the other end which opens into the main body, and said flow indicator includes a measuring chamber formed by extending part of the water supply pipe in diameter, the peripheral wall of said measuring chamber being formed of a transparent material, and a moving body disposed in the measuring chamber so as to be movable in accordance with the flow rate of the water passing through the water supply pipe and having a scale for indicating the flow rate.

13. The washing machine according to claim 1, wherein said main body includes a dryer vessel rotatably disposed in the dryer tub, a sprinkling cylinder rotatably disposed in the dryer vessel and adapted to sprinkle water on the laundry in the dryer vessel while rotating, and a water supply pipe for feeding the water discharged from the filter into the sprinkling cylinder.

14. The washing machine according to claim 13, wherein said main body includes a lid for opening and closing the upper opening of the dryer tub, said lid constituting a flooder for leading the water fed from the water supply pipe into the sprinkling cylinder.

15. The washing machine according to claim 1, wherein said body case includes an overflow port located at a predetermined height in the inflow chamber and communicating with the outside air.

16. The washing machine according to claim 15, wherein said body case includes an upper opening through which the filtering member is inserted into and removed from the body case, and a lid removably mounted on the body case to close the upper opening.

* * * * *